US005396064A

United States Patent [19]

Wells

[11] Patent Number: 5,396,064

[45] Date of Patent: Mar. 7, 1995

[54] QUADRUPOLE TRAP ION ISOLATION METHOD

[75] Inventor: Gregory J. Wells, Fairfield, Calif.

[73] Assignee: Varian Associates, Inc., Palo Alto, Calif.

[21] Appl. No.: 180,174

[22] Filed: Jan. 11, 1994

[51] Int. Cl.[6] ..... H01J 49/42

[52] U.S. Cl. ..... 250/282; 250/292

[58] Field of Search ..... 250/282, 292, 281

[56] References Cited

U.S. PATENT DOCUMENTS 5,198,665 3/1993 Wells ..... 250/282

5,274,233 12/1993 Kelley ..... 250/292

5,300,772 4/1994 Buttrill, Jr. ..... 250/282

5,302,826 4/1994 Wells ..... 250/292

*Primary Examiner*—Jack I. Berman

*Attorney, Agent, or Firm*—Gerald M. Fisher

[57] ABSTRACT

A method for efficiently filling a QIT which isolates an ion range by employing a sequential part of supplemental broadband waveforms where the first such supplemental broadband waveform is applied during the period that the e-beam ionization bombardment takes place and the second such broadband waveform is applied after the e-beam bombardment ends.

14 Claims, 10 Drawing Sheets

QUADRUPOLE TRAP ION ISOLATION METHOD

FIELD OF THE INVENTION

This invention relates to an improved method and apparatus for isolating an ion of interest in a quadrupole ion trap.

RELATED APPLICATIONS

This patent application is an improvement to the ion isolation technique of the same inventor in U.S. Pat. No. 5, 198,665, owned by the same assignee, the specification of which is incorporated herein by reference.

BACKGROUND OF THE INVENTION

In recent years the quadrupole ion trap (QIT) has been becoming of great importance in analytical instrumentation. The QIT was first disclosed in 1952. The history of its development and details of its construction and operation have been set forth in various papers, including the book entitled "*Quadrupole Storage Mass Spectrometry*" by March and Hughes, published by John Wiley & Sons 1989. Briefly, the QIT is a mass spectrometer which employs radio frequency fields and does not require the use of a magnet for separating ions and providing a mass spectrum of an unknown sample. The sample to be analyzed is first dissociated/fragmented into ions inside the QIT, which ions are charged atoms or molecularly bound groups of atoms. The QIT is capable of providing motion restoring forces on selected ions in the three orthogonal directions and can therefore retain the selected ion inside the QIT.

There are several common techniques in use for determining the spectrum of ions in the QIT. By manipulating the electric fields within the trap, it has been possible to scan, i.e. cause consecutive values of m/e of the stored atoms to become unstable, so that the separated ions pass into a detector and the detected ion current signal intensity, as a function of the scan parameter is the mass spectrum of the ions being analyzed.

An alternative scan method employs a single supplemental dipole frequency applied to the quadrupole trapping field combined with changing the quadrupole RF field voltage so as to bring the secular motions of the trapped ions of consecutive m/e sequentially into resonance with the supplemental field causing their amplitudes to increase until the ion leave the trapping region. This method of scanning is referred to as resonance scanning. Other non-scanning spectrum determining techniques are described in another application (Varian Case No. 93-22) entitled "*A Method of Space Charge Control for Improved Ion Isolation in a QIT*", filed Jan. 10, 1994. These other methods include measuring image current and integrating it to determine amount of charge in the trap in a manner similar to the Ion Cyclotron Resonance Spectrometer detection (ICR) and FT-ICR or by simultaneously ejection of ions in the trap by a DC voltage applied to one end cap or setting the RF trapping voltage to zero. The simultaneously ejected ions could then be separated by the technique of ion selection employed in time-of-flight spectrometers.

There are several important experiments where it is very important to first isolate within the QIT an ion of a particular m/e or a range of such ions. One such particular experiment is called MS/MS. This is the experiment where a particular ion is isolated, as a parent ion, then the parent is dissociated by gentle collisions, generally called collision induced dissociation (CID) to obtain daughter ions. The commonly assigned U.S. Pat. No. 5,198,665 described earlier as a related patent describes one such isolation method for CID.

There are three types of sample ionization methods in common use. These are E-beam or Electron Ionization (EI), Collision Induced Dissociation (CID) and Chemical Ionization (CI). The e-beam is an adjustable energy electron beam which is caused to impact the ions at high velocity and causes violent fragmentation of a particle. CID is where the ions formed by other processes, such as EI or CI are caused to oscillate in the trap which results in collisions with a background gas resulting in the fragmentation of the ion to form an ion of smaller m/e and a neutral fragment. CI relates to a technique for inducing a chemical reaction between two different materials to form an ionic product.

To carry off a chemical ionization experiment, a neutral reagent gas is introduced into the trap and is ionized by use of an e-beam. The resulting ions of the reagent gas then react with a neutral sample to form an ion of the sample; usually by a proton transfer reaction from the reagention to the neutral sample. One problem with this approach is that the spectrum is too complex and creates several reagent ions which have different chemical properties as well as sample ions form by both EI and CI and the desired ion needs to be isolated.

It is known that species of the reagent ion have quite different properties. The different species transfer different amounts of energy to a sample molecule. Electron bombardment methods produces $CH_2^+$, $CH_3^+$, $CH+_4^+$, $CH+_5^+$, $C_2H_3^+$, $C_2H_4^+$, $C_2H_5^+$, $C_3H_5^+$. These ions are formed by direct bombardment as well as by ion molecule reactions between precursor ions of the reagent gas (formed by EI) and the remaining neutral reagent gas. Each type of ion will produce a different series of product ions when chemically ionizing a sample. Accordingly, the spectra can be very complex. There is a need to provide a single mass isolated reagent ion.

New QIT techniques for isolation of ions have been developing rapidly. However, the available techniques have drawbacks. Marshall, et al. U.S. Pat. No. 4,761,545 taught the use of an inverse Fourier transform with non-linear phasing to produce a supplemental broadband waveform which was applied to the QIT end caps. The Marshall waveform has a notch in the frequency spectrum to eject those ions from the trap whose secular resonance frequencies are outside the notch and to isolate those ions whose secular frequencies are within the notch. Franzen, et al., European patent 362432A1 teaches use of a notched broadband supplemental waveform to selectively store ions and increase their population during e-beam ionization. Kelly, U.S. Pat. No. 5,134,286 created the broadband waveform by employing uniform noise and filtering to obtain a notch. In my earlier '665 patent, a method for isolating a single narrow range of ions is disclosed employing a two step process for CID which employs the scan of the RF field in combination with a supplemental dipole field scanned resonant ejection for the lower m/e ions and a broadband waveform with no notches for ejecting the larger m/e ions. The Marshall, Franzen and Kelly approaches employ low values of RF field during ionization. This results in poor mass resolution for high mass values. My earlier method has improved high mass resolution but has a problem in that after ejection of lower m/e ions, it has no means for ejecting newly formed lower m/e ions which are created by CID during the final step of ejecting the higher mass ions. These lower m/e ions are called "shadow ions".

Louris, U.S. Pat. No. 4,686,367 discloses the method for producing CI reagent species in a trap by electron bombardment. Rejection of the ions above a selective cut-off by mass instability scanning is disclosed. Kelly, in U.S. Pat. No. 4,196,699, uses filtered noise on the end caps during ionization to eject unwanted ions of the reagent and sample gas during ionization. Weber, et al., U.S. Pat. No. 4,818,869 and Barberich, *Intern. J. Mass. Spec. and Ion Proc.* V 94, P. 115–147 (1989) teaches ion isolation by a method to mass select the CI reagent ion after the end of the initial ion formation period, i.e. the ionization time plus a precursor reaction period. In this method, the precursor ions, which themselves may be reagent ions must be in the trap to form other species of reagent ions. After the end of the reagent formation period, a DC pulse is applied. This does not prevent the formation of additional low mass reagent ions by charge exchange or ion forming processor after the DC pulse mass isolation step. Also, the filtered noise method of the Kelley patent must allow the trapping of all the precursor ions since it is on only during the e-beam ionization step, period A of FIG. 4 of '689 patent, and is off during the reaction step, period B in FIG. 4 of '689 patent. Accordingly, Kelly also has no provision for isolation of a single mass isolated reagent species, without also isolating all precursor ions that lead to the formation of the desired reagent ions.

DETAILED DESCRIPTION OF THE INVENTION

Figure 1:
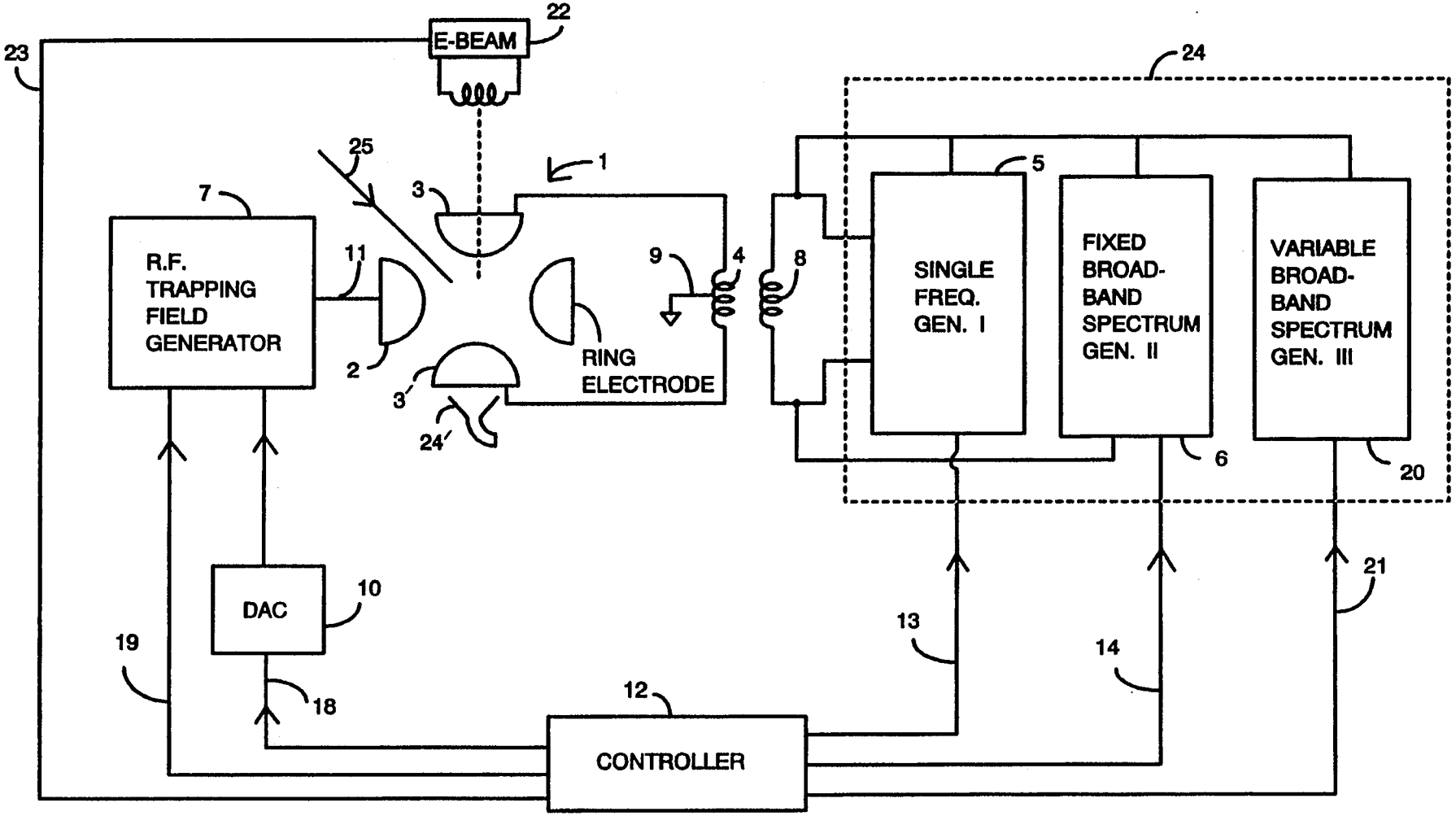
FIG. 1 is a schematic block diagram of a QIT with a full capability supplemental waveform generator.

The QIT apparatus of FIG. 1 shows prior art known structure for introducing a sample gas via conduct 25 into a QIT 1 comprising ring electrode 2, end caps 3 and 3'. Under controller 12 commands, e-beam exciter 22 provides an electron beam through an end-cap into the interior of the trap for bombarding and ionizing the material in the trap. The RF trapping field generator is connected to the ring electrode and is also under the command of the controller 12 for sequencing and voltage level control. Connected to the end caps is a center tapped 9 primary of transformer 4 which couples the Supplemental Frequency Generator 24 to the transformer secondary 8. The Supplemental Frequency Generator includes the ability of providing at least three distinctly different frequency spectra. This includes a fixed Frequency Generator I, Fixed Broadband Spectrum Generator II, and a Variable Broadband Spectrum Generator III. Technically, since these various supplemental frequencies are not required to be actuated simultaneously, a single multifaceted supplemental frequency generator could satisfy the requirements of this invention.

Figure 3A:
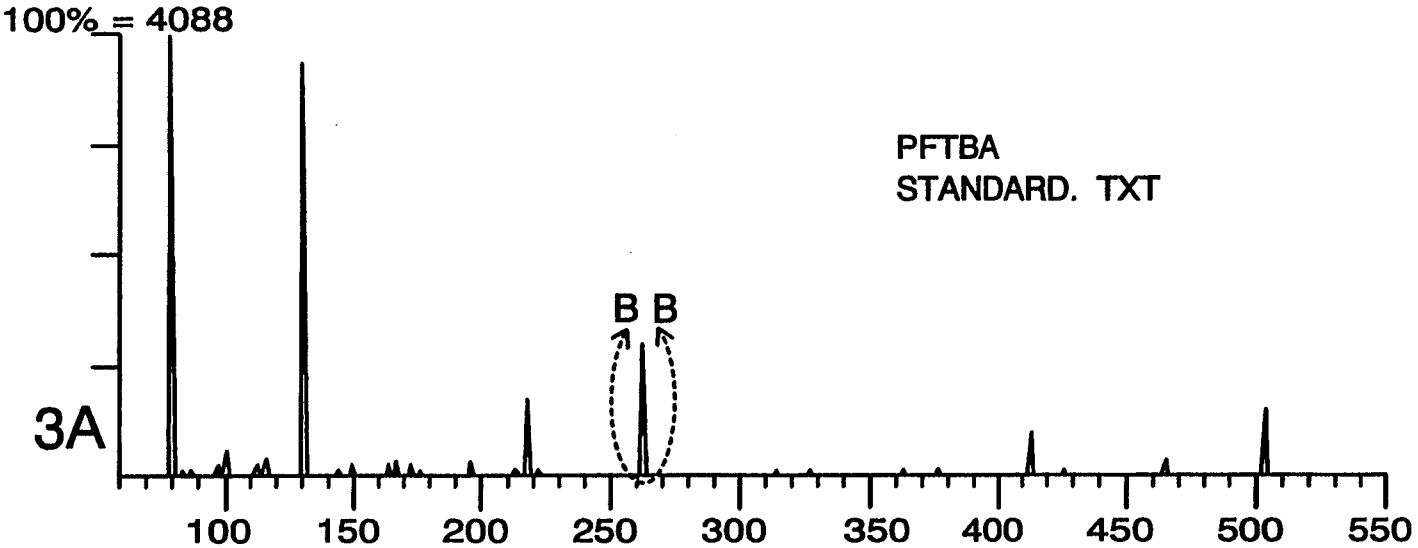
FIG. 3A is the standard spectrum for PBTFA calibration gas for 804>m/e>44.
Figure 3B:
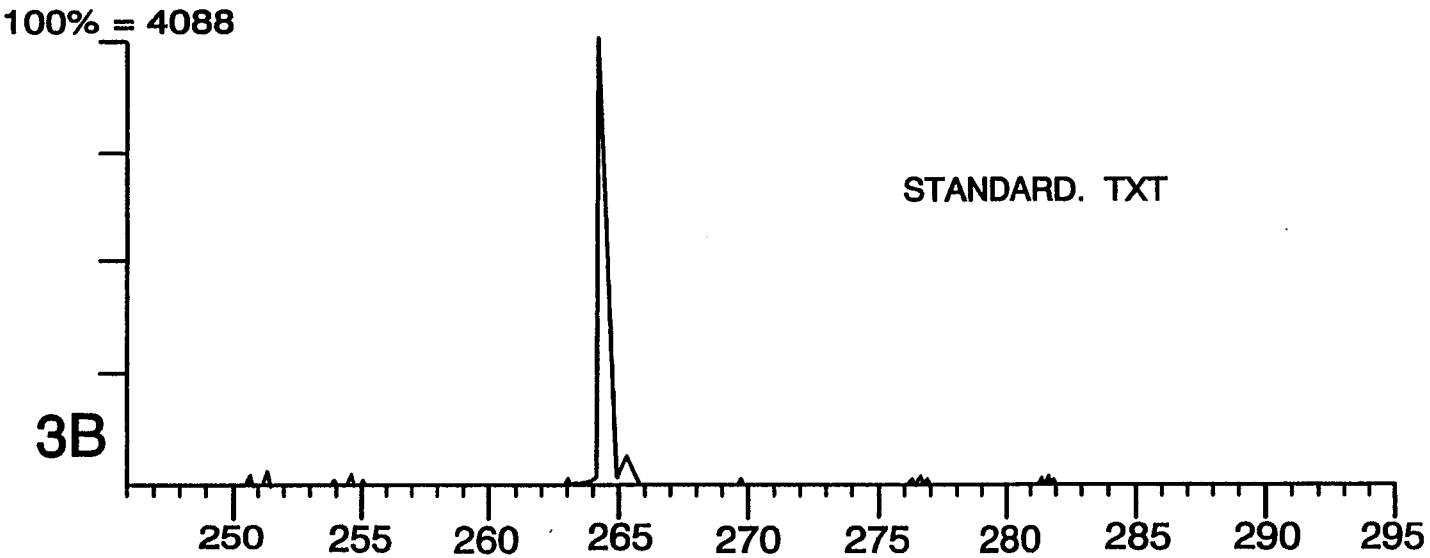
FIG. 3B is an expansion of FIG. 3A for m/e near 265.
Figure 4A:
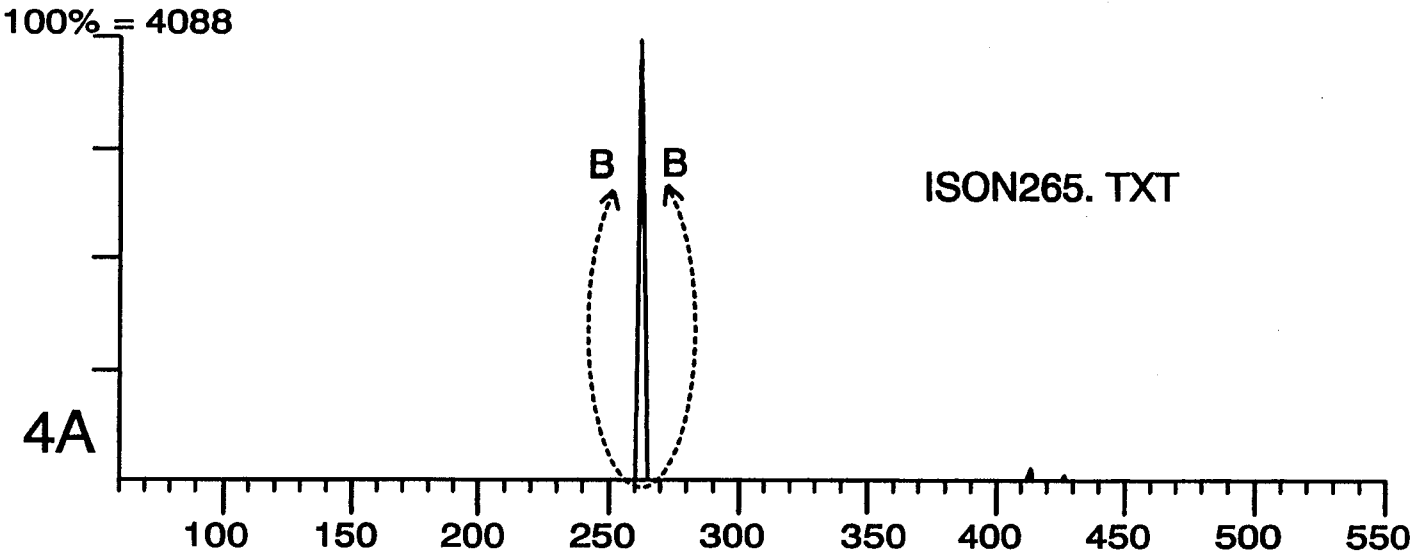
FIG. 4A shows the isolation of m/e=265 using the Well's method of U.S. Pat. No. 5,198,665.
Figure 4B:
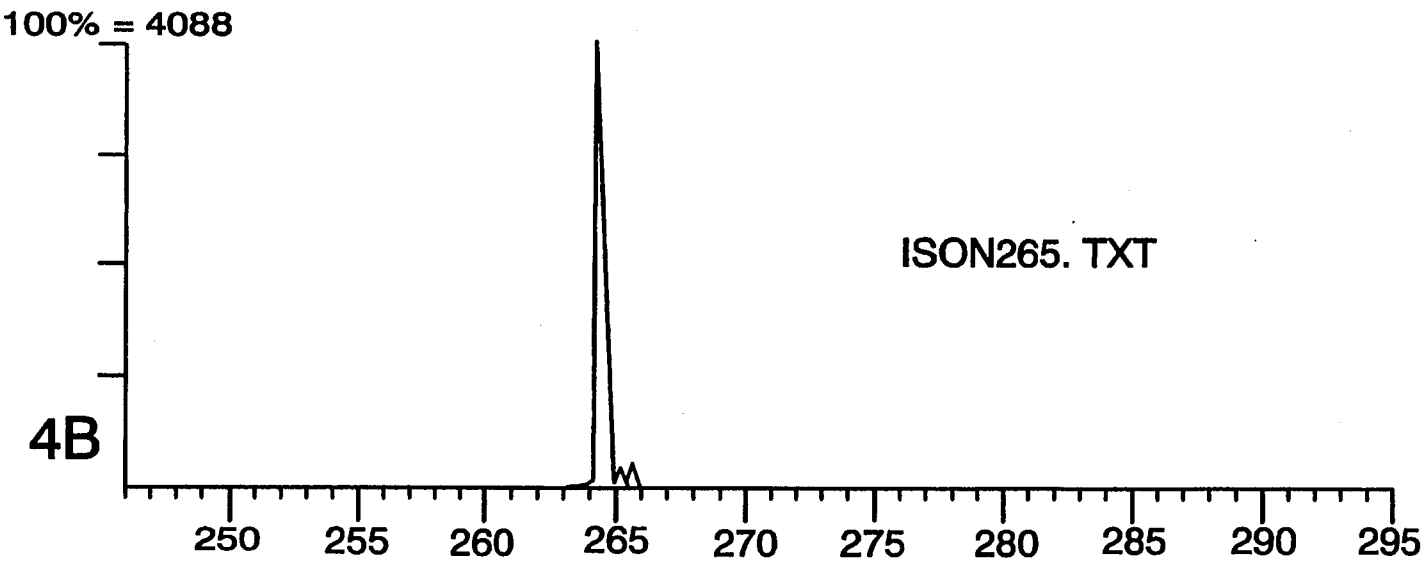
FIG. 4B shows an expansion of FIG. 4A for region near m/e=265 according to the instant invention.

With reference to FIG. 3A, the m/e spectrum of the standard PFTBA calibration gas is shown. FIG. 3B shows the expansion of FIG. 3A around the me/=265 ion. The difficulty with the prior art Well's '665 patent method can be seen by performing the Well's two step process on the PFTBA calibration gas for the me/=265 ion. The results of this can be seen in FIG. 4A and FIG. 4B. As seen in FIG. 4B which is an expansion of FIG. 4A, most of the ion intensity is from the me/=264 ion. It has been determined that these m/e 264 ions are actually formed during the ion ejection step when the ions of greater mass than the specified parent ion are ejected by the application of the broad band waveform of the Well's '665 method. Some of the high mass ions (mass 502 to be specific) dissociate instead of being ejected and form me/=264. Since the lower masses than 265 had been ejected in the Wells' first step, these ions remain in the trap as so called "shadow ions". In addition, there are additional ions of mass 265 that are formed by a similar dissociation of mass 503.

Figure 2A:
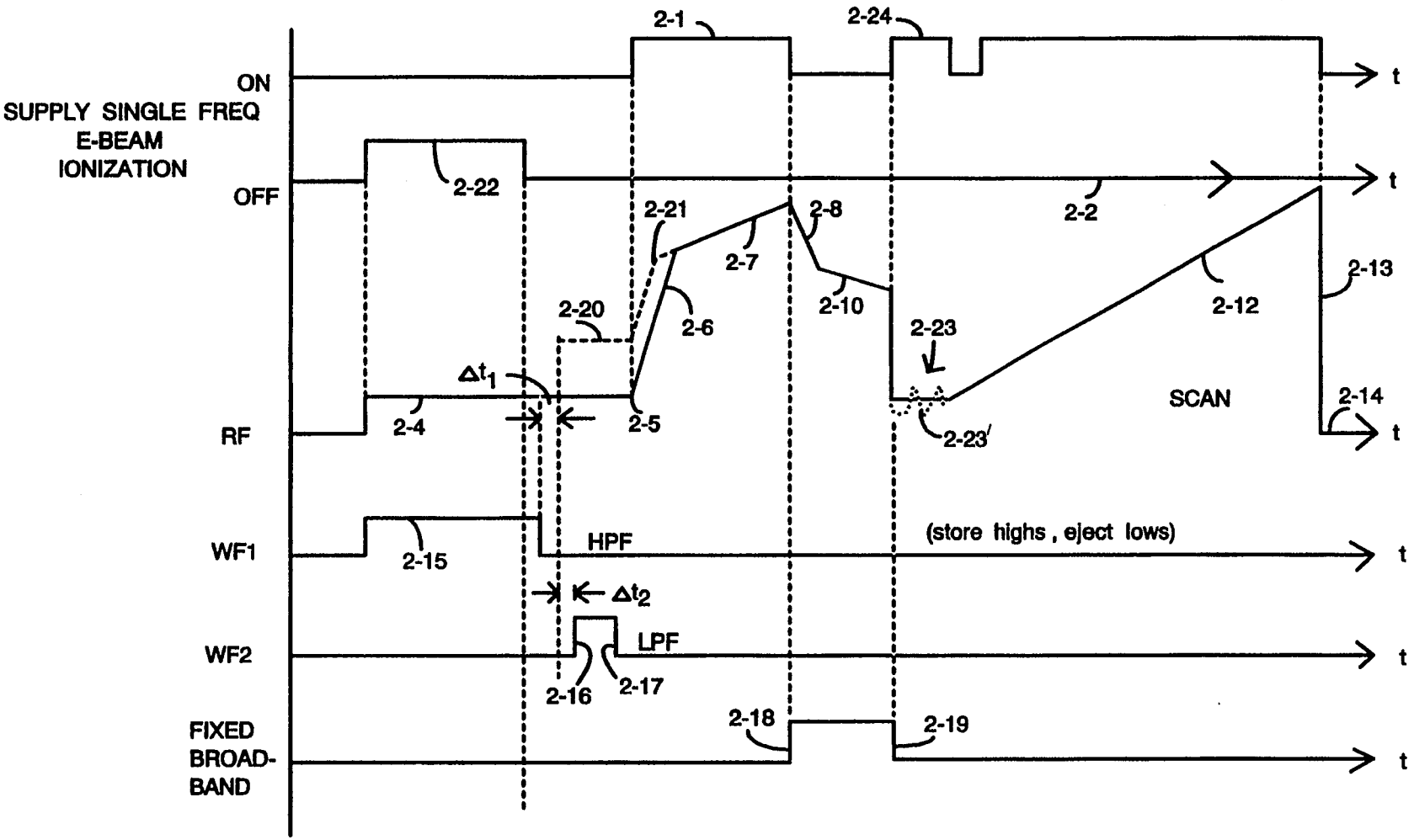
FIG. 2A is a pulsing and scanning sequence for the method of this invention for m/e sample isolation to support experiments such as MS/MS.
Figure 4C:
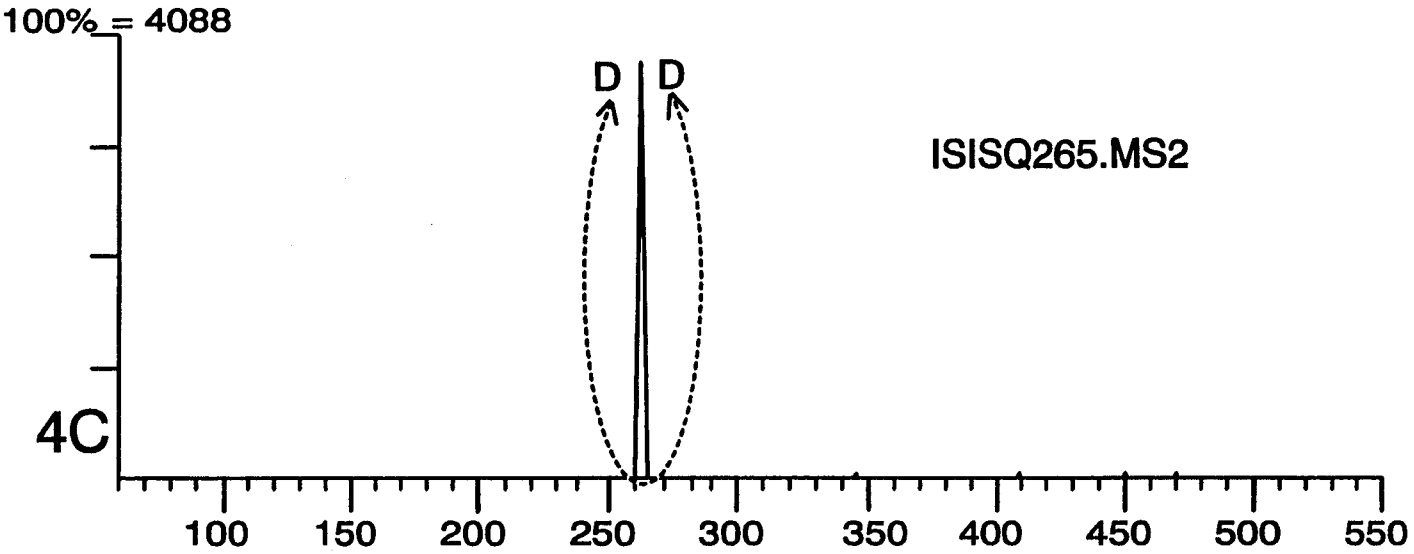
FIG. 4C shows the isolation of m/e=265.
Figure 4D:
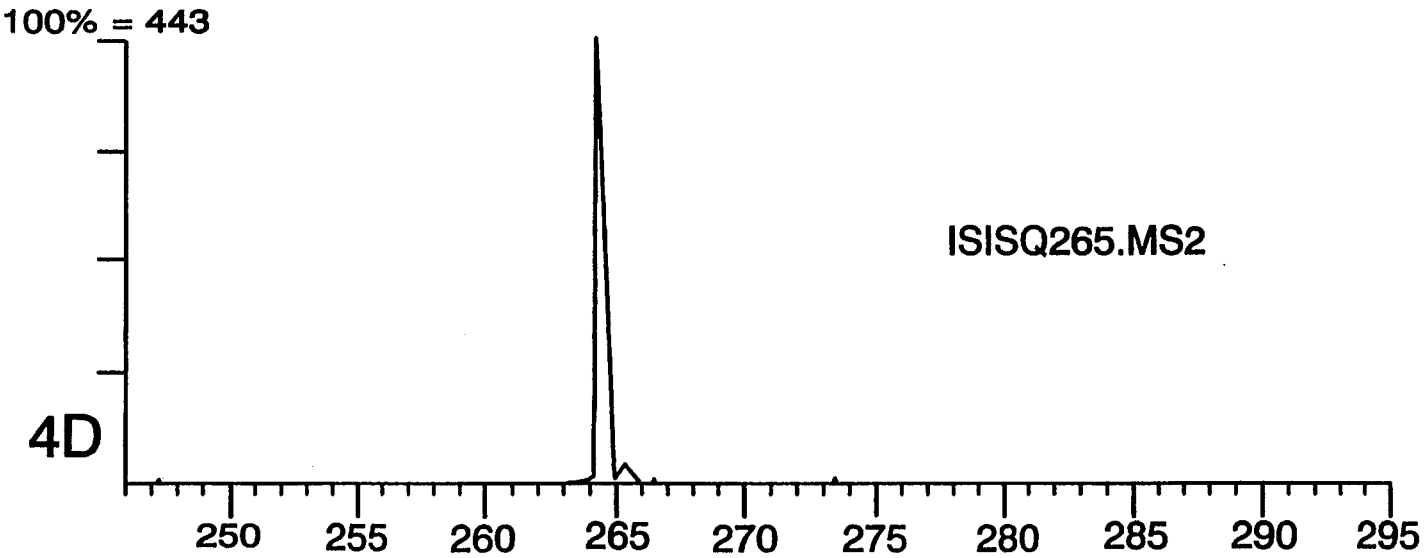
FIG. 4D shows an expansion of FIG. 4C for m/e=265.

With reference to FIG. 2A, the pulse sequence of the method of this invention are described in connection with isolation of me/=265. This sequence enables one to obtain the spectrum of FIG. 4C and FIG. 4D. FIG. 4D shows the result in that the me/=264 ions have been ejected and the me/=265 ions were isolated.

As shown in FIG. 2A, the RF Generator 2 is excited at a flat low voltage level 2-4 and the e-beam 2-22 is on at the same time that supplemental broadband pulse WF1, 2-15, is applied to the end caps from the Variable Broadband Generator 20.

The broadband pulse 2-15 is made up of frequencies higher than the secular frequency of the m/e=265 ion. This is called a High Pass Filter (HPF) because the trap stores the high mass/charge ions and ejects the low mass/charge ions.

After the e-beam 2-22 is turned off, the Supplemental Generator pulse switches from WF1 spectrum to WF2 spectrum, 2-16. The WF2 spectrum is selected to provide frequencies to resonate with secular frequencies of ions having m/e higher than 265. Following the application of these two pulses, a standard Wells sequence of U.S. Pat. No. 4,198,665 is employed. This sequence ramps up the RF field voltage 2-6 and 2-7 while applying the single supplemental frequency 2-1 to the end caps for scamped resonant ejection and then ramps down 2-8 and 2-10 while simultaneously applying a fixed supplemental broadband spectrum 2-19 in the range 450 KHz down to 10 KHz as described in the '665 patent.

At the time corresponding to region 2-23 in the RF Generator sequence, the desired ion is isolated such as shown in FIG. 4D, and subsequent experiments may be carried out, such as applying a single tickle frequency 2-24 which may be different than that used in period 2-1 from Generator 5 and modulation of the RF voltage 2-23' for gently ionizing the parent ion by Collision Induced Dissociation (CID) as described in the simultaneously filed co-pending application entitled "A Method of Selective Ion Trapping for Quadrupole Ion Trap Mass Spectrometers", inventors, Wells and Wang, (Varian Case No. 93-24).

Figure 2B:
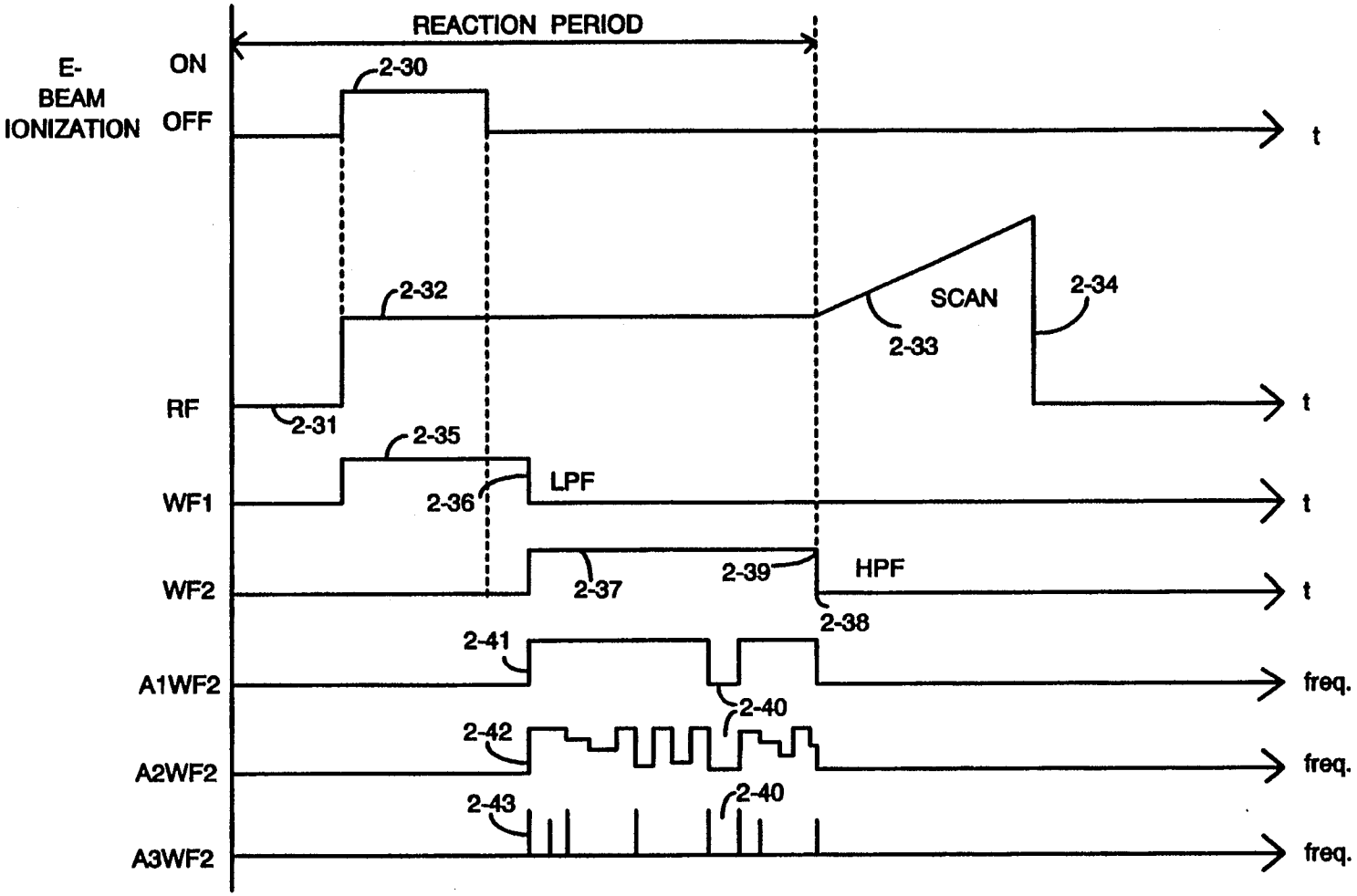
FIG. 2B is a pulsing and scanning sequence for the method of this invention for M/e reagent ion isolation to support chemical ionization with a single reagent ion.

In the preferred embodiment of the invention, the waveforms used in WF1 and WF2 would be constructed of frequencies spaced apart in the frequency domain less than the width of the ion resonance in the frequency domain. An alternative method is also shown in connection with FIG. 2A. It is not required that the amplitude of the RF Generator remain at a constant level 2-4 during the application of WF1 and WF2. As shown, the RF level can be increased or decreased as depicted at 2-20 during WF2 from the value during WF1. This permits both the mass below and the mass above the selected ion to be independently optimized by adjusting the relative RF voltage that is used for each waveform without requiring recalculation of the frequency spectrum for the broadband waveform. Changing the absolute value of the RF voltage will allow m/e of the selected ion to be changed. In this alternative however, it is necessary that there be a delay time $\Delta t$, between discontinuing WF1 and initiating the new value 2-20 of the RF field. It is necessary that the RF voltage is stable or is given an opportunity to become stabilized before switching of WF1 to avoid scanning effects. Similarly, a delay $\Delta t_2$ is required before WF2 is turned on for the same reason. With reference now to FIG. 2B, the application of the invention is described with specific application to chemical ionization experiments. In chemical ionization, a reagent gas is introduced into the trap and the gas is bombarded with electrons to create the reagent ions which will react with the sample to produce the sample spectrum. However, there are several problems. One such problem relates to the fact that it is impractical to discontinue flowing the output from a gas chromatograph which is a common method used to introduce sample into a QIT. This means that sample ions are created during e-beam bombardment of the reagent. The sample ions formed during ionization of the reagent gas are the result of E1 (Electron Ionization) and thus produce a different mass spectra than that which results from CI (Chemical Ionization) of the sample. An additional problem exists in that several different reagent ions are formed which in turn results in the formation of different sets of CI product ions. Lastly, it should be appreciated that the relative intensity of the various reagent ions of differing m/e will change as a function of time since some of the reagent ions are also precursor ions which will react with the neutral reagent gas to reagent ions of higher mass. The net result of these various undesired processes is that the CI spectrum of the prior art is a complex mixture of ions formed by several processes.

The method of this invention for isolation of an ion for MS/MS as described in FIG. 2A, sequentially applies two different broadband waveforms. The first waveform is being applied simultaneously in time with the e-beam ionization bombardment, and the second waveform is applied substantially immediately following cessation of the first waveform. The same two concept of a waveform sequence where the first waveform overlaps the e-beam ionization can also be advantageously employed in connection with chemical ionization. However, in the CI case, the isolation of a specific reagent ion is sought. Unlike the MS/MS method where low mass space charge has an undesired affect on the storage of higher mass parent ions, the low mass charge in the CI method is necessary since it is the reagent ion. It is the higher mass sample ions formed by E1 during the reagent ion formation that are undesired. Thus there is the further distinction that in the CI isolation method, the first waveform which is co-existing with the e-beam ionization is a low pass filter pulse (LPF) i.e. stores low and ejects high m/e ratio ions. This WF1, 2-35, pulse (LPC) is employed to eject all those high mass fragments which result from bombardment of the sample. This is required since the sample ions are present in the trap along with the precursor for the reagent ions. However, this spectrum does not eject any of the precursor reagent which are necessary to produce the reagent ions for the reaction period after the e-beam is switched off. It is sometime advantageous to allow an additional time period after the end of the ionization period in which the LPF is still active. This additional time is often used to allow precursor ions to more completely react to form other reagentions. The LPF is such that it ejects all masses above the final reagent ion that is to be isolated. When the LPF pulse (WF1) is switched off, the WF2 (HPF), 2-3, is switched on. The HPF pulse is a broadband waveform which is selected to excite the secular frequency of all those ions having m/e less than the selected reagent ion and to permit storage of ions having higher m/e rations. The HFP is on throughout the entire reaction period, thus eliminating any lower mass ions that would be formed by charge transfer and dissociation processes.

Figure 5:
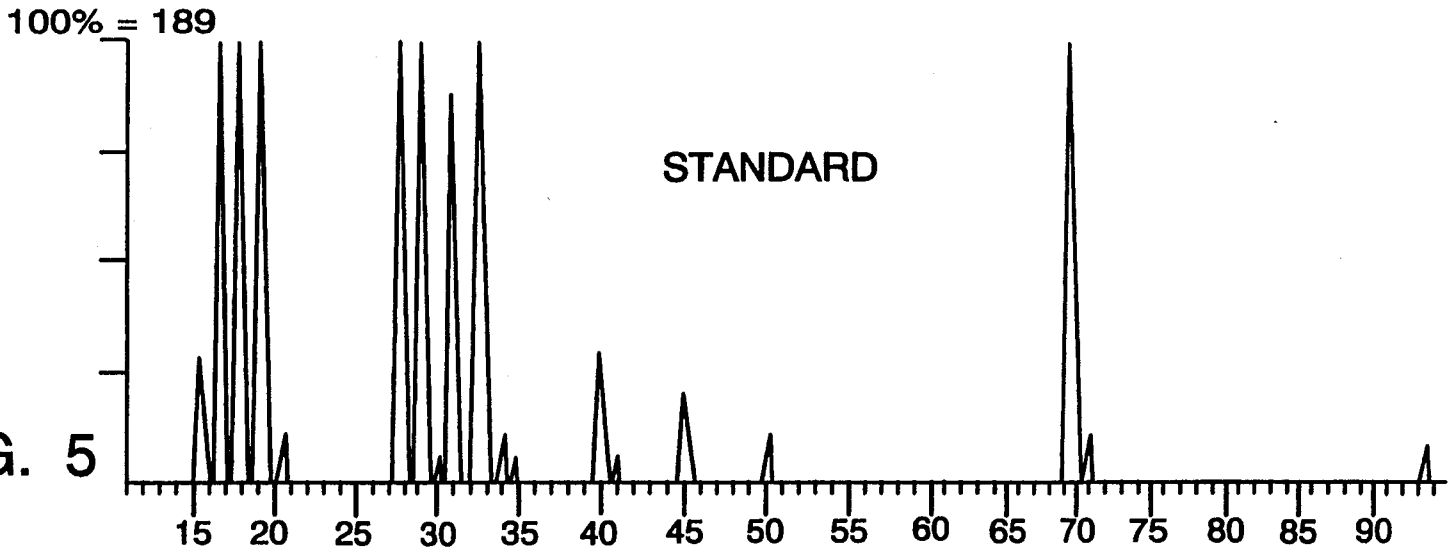
FIG. 5 shows the spectrum for e-beam ionization of air, $H_2O$ vapor, and PBFTA in trap in large excess.

FIG. 5 is illustrative of spectra from air, water and calibration gases present in large excess in a QIT which is subjected to EI. The spectrum is obtained by a resonant scan. This spectrum is seen to be extremely complex. For purposes of illustrating the benefits of the inventive method, I have selected the ion of me/=29 to demonstrate the ability of my method to select a reagent ion for CI.

Figure 6:
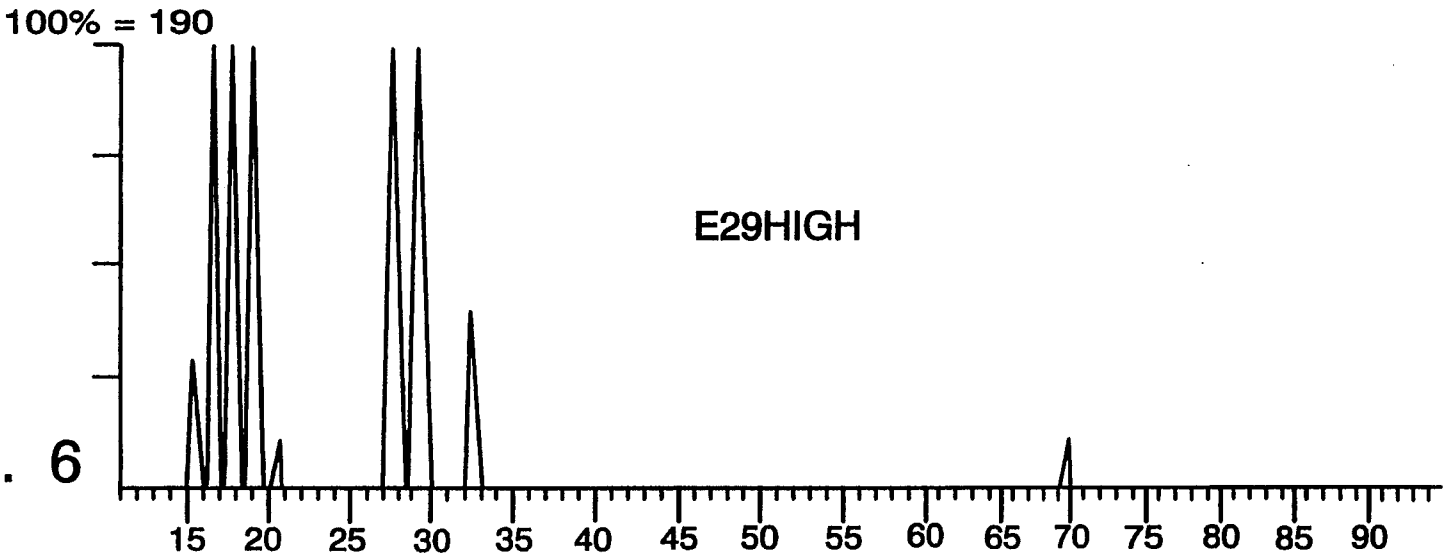
FIG. 6 shows the spectrum of same materials as in FIG. 5 after application of WF1 (2-35) of FIG. 2B during ionization only.

FIG. 6 is illustrative of the spectrum using WF1 broadband supplemental waveform calculated to reject all those m/e ions greater than m/e=29. Note a small intensity of ions at m/e=32 which comes from charge transfer from lower ions to neutral oxygen molecules.

Figure 7:
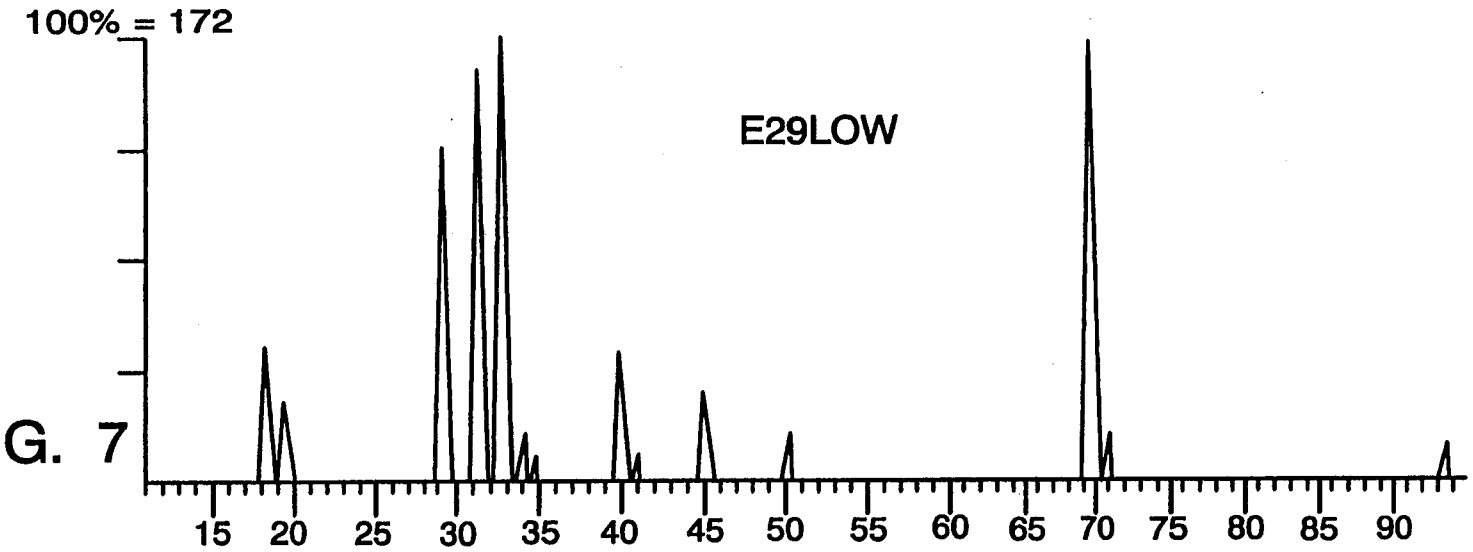
FIG. 7 shows the spectrum of the same materials in FIG. 5 after Application of WF2 (2-37) after end of ionization and throughout remainder of reaction period for ejection of m/e<29.

FIG. 7 illustrates the spectrum after application of WF2 (without prior WF1) to the air, water and calibration gas, with WF2 applied as illustrated in FIG. 2.B at the end of the ionization period and throughout the remainder of the reaction period. WF2 is the broadband waveform calculated to eject all the ions having me/=29. The small intensity of the me/=18 and 19 is due to charge transfer to fragments of higher mass ions in the trap.

Figure 8:
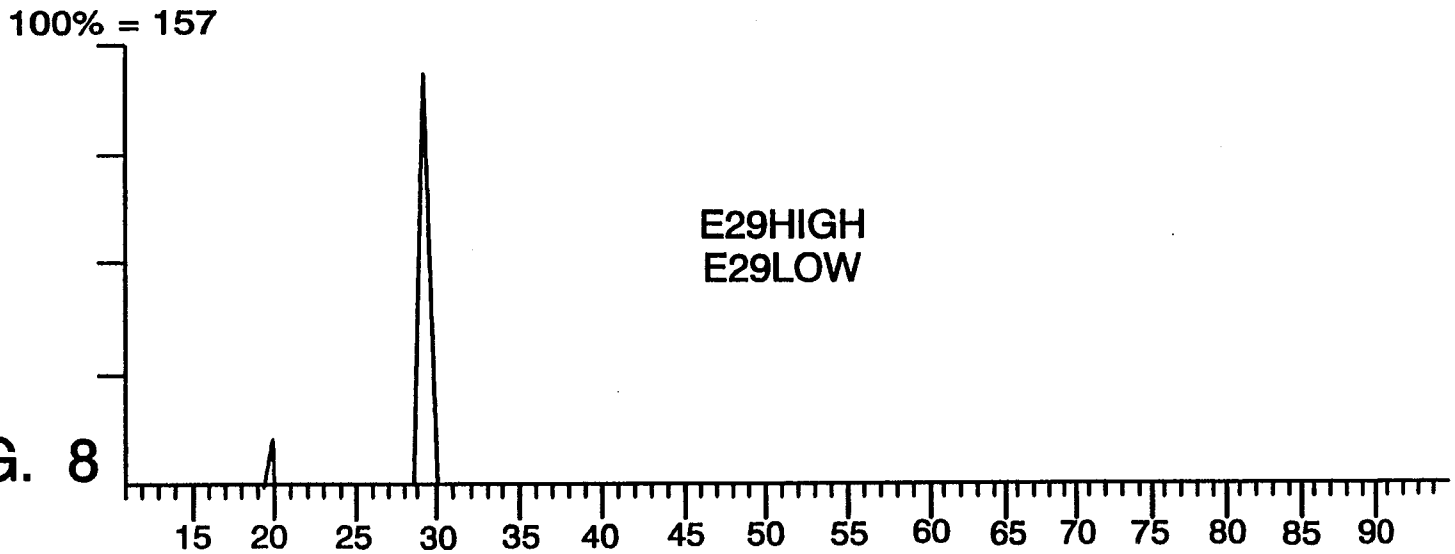
FIG. 8 shows the spectrum of the same materials after the sequential application of WF1 and WF2 of this invention.

FIG. 8 is the result of the application of the sequence of the invention employing the WF1 and WF2 as depicted in FIG. 2B. It can be seen that essentially all ions are removed from the trap except for the selected ion.

Figure 9:
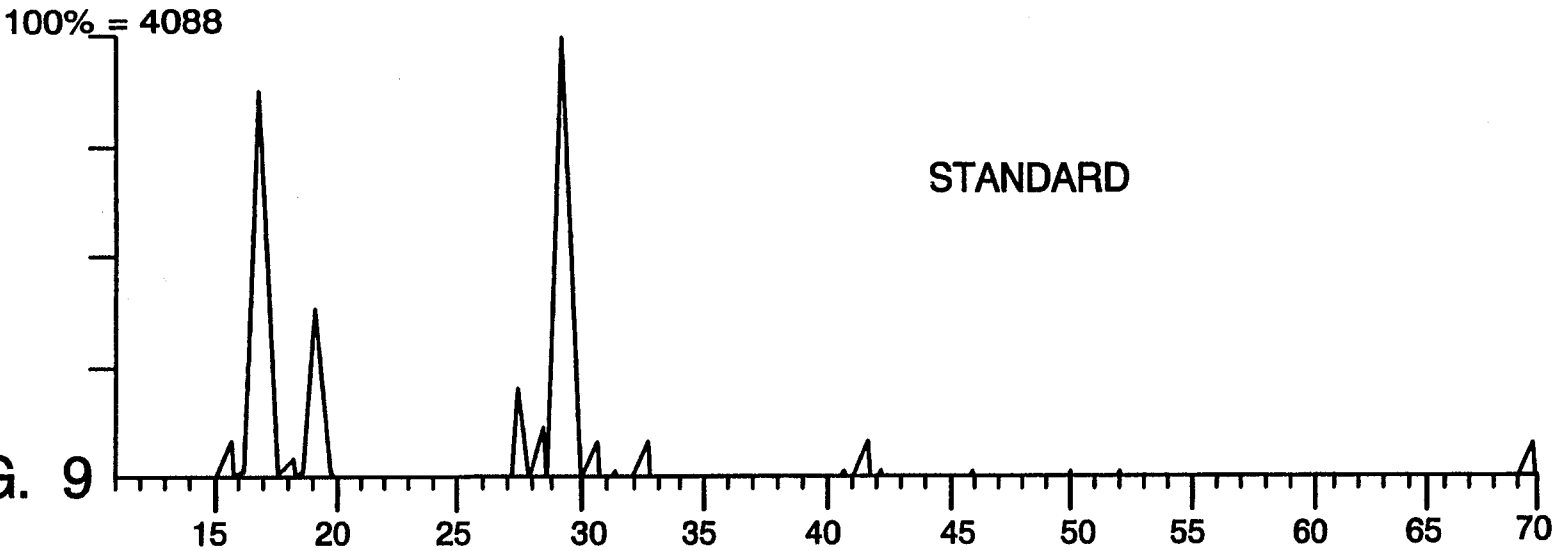
FIG. 9 shows the spectrum 10>m/e<90 of PTBFA and methane as a precursor reaction gas for CI.
Figure 10:
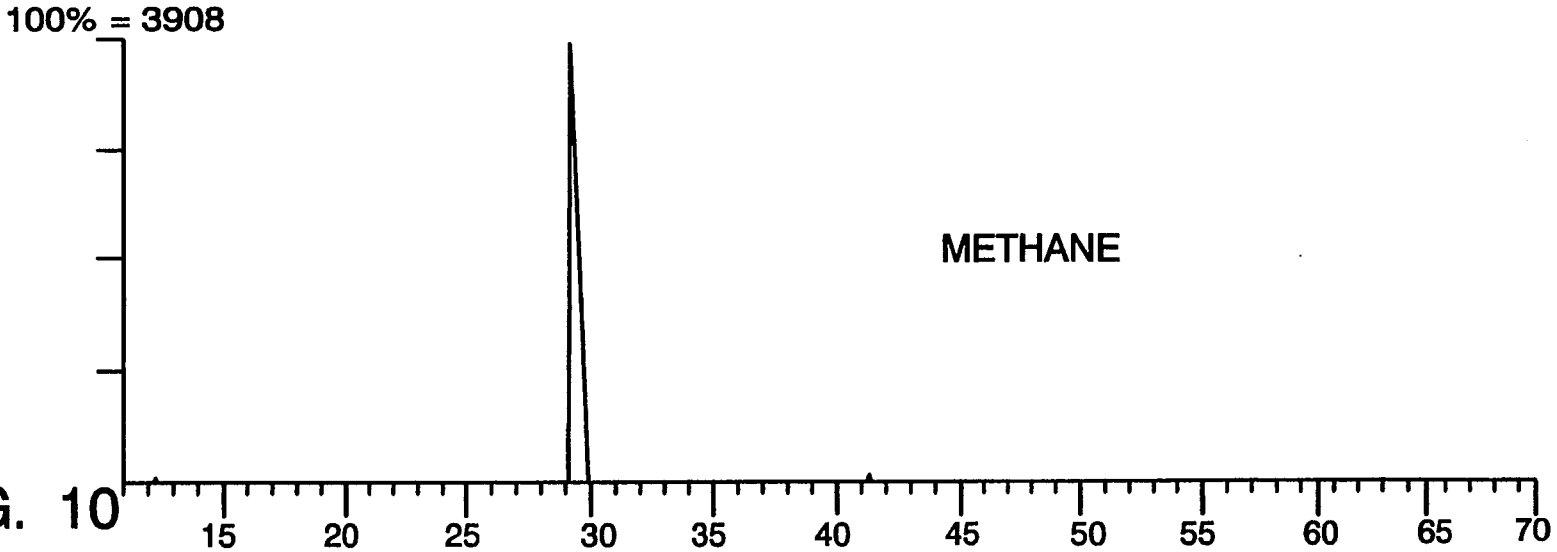
FIG. 10 shows the spectrum of materials of FIG. 9 after application of WF1 and WF2 of this invention for isolation of m/e=29.

FIG. 9 illustrates the process of the instant invention in connection with the use of methane as the reagent gas for a chemical ionization experiment. FIG. 9 spectrum is the standard e-beam spectrum for methane and PFTBA calibration gas. The large intensity of ions at me/=19 is due to protonation of neutral water. FIG. 10 shows the spectrum for the methane plus PFTBA isolation for methane reagent ion m/e=29 employing the technique of the current invention.

Figure 11:
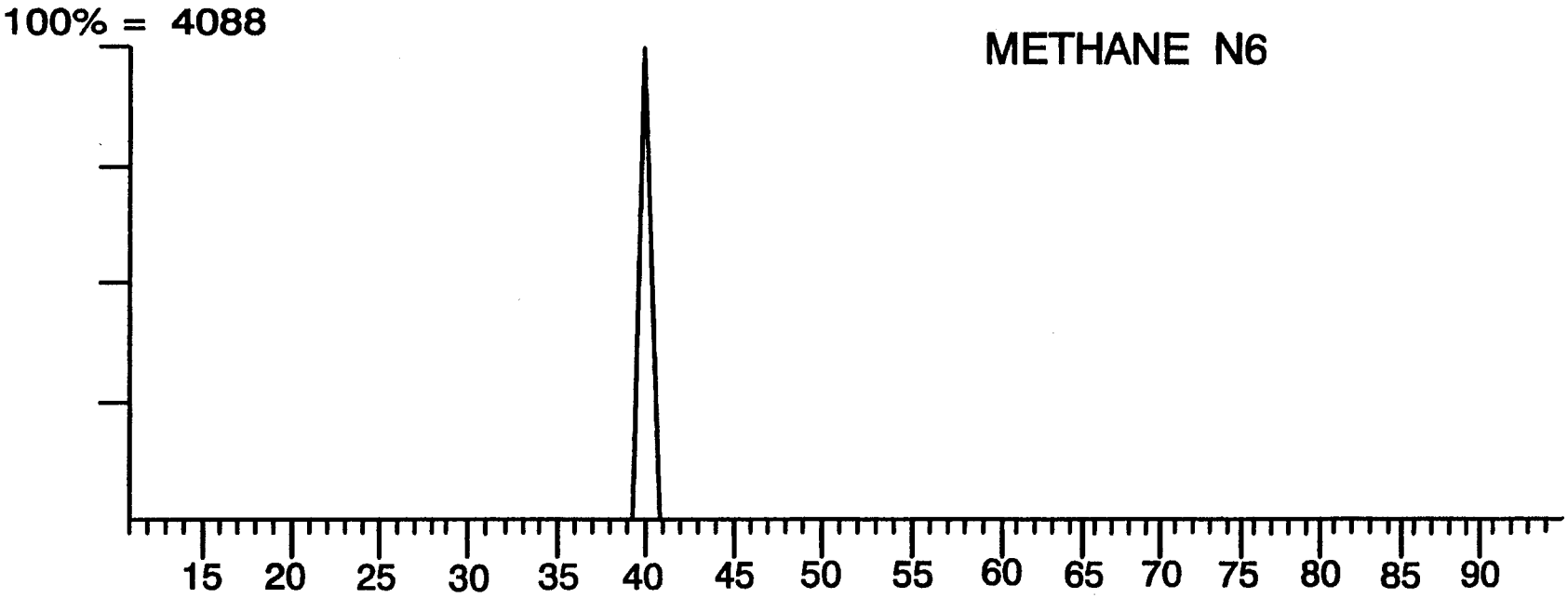
FIG. 11 shows the spectrum of the same materials of FIG. 9 applying the WF1 and WF2 of this invention to isolate m/e=41.

FIG. 11 shows the spectrum for the methane plus PFTBA employing WF1 and WF2 of this invention calculated to isolate the ion at m/e=41. It is also noted that for the same ionization time than the ion intensity for m/e=41 is much larger than the intensity of the m/e as seen in FIG. 9. This illustrates how this technique permits the trap to be maximally filed with only the desired reagent ion.

In FIG. 2B, there are several alternative broadband waveforms for WF2. The alternative 2-41 shown as A1WF2 contains a notch in the frequency domain representation. For example, for isolation of the m/e=29, the waveform A1WF2 would contain frequencies to eject ions from the lower mass stability limit, i.e. in this case m/e=12, up to and including m(p)−1, i.e. m/e=28, and then from the mass m(p)+1, i.e. m/e=30 to the largest mass that could be produced by the reagent gas, i.e. m/e=41.

Another alternative A2FW2, 2-42 for WF2 allows tailoring of the amplitudes of the frequency components of the waveform so as to maximize the ejection of the ions throughout the mass range while still maintaining good mass resolution. A still further alternative for WF2 is A3WF2, 2-43, which is a frequency domain in which the frequencies are spaced to match the secular frequencies of the undesired ions.

The foregoing descriptions of the preferred embodiments were described in connection with determination of the spectrum of the QIT trapped ions by sue of an external detector. This invention would also be useful in connection with other techniques for determining the spectrum of the trapped ions such as those techniques described in the Background of the Invention which do not employ ejection and external detection of ejected ions.

The examples described and shown in the specification and drawings are the preferred method and it is not my intent that my invention should be limited to those examples. It is my intent than the scope of the invention shall be determined by the claims. With this in view,

What is claimed is:

1. In a method for isolating a selected ion having a mass m(p) in a quadrupole ion trap (QIT) system, and said QIT system having a ring electrode, a pair of end caps, and RF trapping voltage applied to said ring electrode, a supplementary voltage generator connected to said end-caps, said method for isolating a selected ion having a mass re(p) including, (a) establishing said RF trapping voltage at low value;

(b) ionizing by electron bombardment the gas inside said QIT for a first period of time;

(c) during said first period of time applying a first broadband spectrum RF waveform with said supplemental RF generator to said end caps;

(d) determining the mass spectrum of ions in said QIT;

(e) substantially immediately after said first period of time, applying a second broadband spectrum RF waveform with said supplemental RF generator to said end caps.

2. The method of claim 1 for isolating ions for MS/MS wherein step (c) comprises applying a broadband waveform having a frequency spectrum for ejecting ions having m/e less than m(p) and storing ions having m/e greater than m(p).

3. The method of claim 2 wherein step (e) comprises applying said second broadband waveform having a frequency spectrum for ejecting ions having m/e greater than m(p).

4. The method of claim 1 for isolating a reagent ion for chemical ionization (CI) wherein step (c) comprises applying a broadband waveform for ejecting ions having an m/e greater than m(p) and storing ions having m/e less that m(p).

5. The method of claim 4 wherein said step (e) comprises applying a broadband excitation for ejecting ions having m/e less than m(p).

6. The method of claim 3 wherein said RF trapping voltage is switched abruptly to a different trapping voltage level and permitted to stabilize before initiation of step (e).

7. The method of claim 3 wherein said step (d) of ramping down of said RF trapping voltage and wherein during said step of ramping up said RF trapping voltage, a supplemental single frequency waveform is applied to said end caps and during said ramping down a supplemental fixed broadband waveform is applied to said end caps.

8. The method of 5 wherein said step (e) broadband waveform comprises at least a higher frequency range and a lower frequency range separated by a frequency notch, said notch including the secular frequency corresponding to said mass $m_p$.

9. The method of claim 5 wherein said step (e) broadband waveform includes different amplitudes for different frequencies in the frequency domain of the frequencies in said broadband waveform.

10. The method of claim 5 wherein said step (e) broadband waveform includes frequencies in said frequency domain which match the secular frequencies of undesired ions in said QIT.

11. The method of claim 7 wherein said step (d) of ramping up includes ramping up at a first and second different rates, said faster ramping rate being earlier in the time than said second different rate.

12. The method of claim 11 wherein said ramping down including ramping down at a first and second different ramping down rate said faster ramping down rate being earlier in time than said second different ramping down rate.

13. The method of claim 7 wherein after said RF trapping voltage is ramped down it is abruptly reduced to a lower voltage and maintained at said lower voltage for CID excitation period, and wherein during said maintenance of said lower RF trapping voltage a supplemental generator provided a tickle voltage to collisionally induce the selected ion m(p) to gently fragment into daughter ions.

14. The method of claim 8 wherein said higher frequency range extends upward in frequency to include the secular frequency of the lowest mass capable of storage in said ion trap and the lower frequency range extends downward to a frequency beyond that secular frequency of the highest mass to be ejected.

* * * * *